US009911376B2

(12) United States Patent
Kim et al.

(10) Patent No.: US 9,911,376 B2
(45) Date of Patent: Mar. 6, 2018

(54) DISPLAY DEVICE

(71) Applicant: LG Display Co., Ltd., Seoul (KR)

(72) Inventors: HwaYoung Kim, Paju-si (KR); MyungKook Moon, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/134,157

(22) Filed: Apr. 20, 2016

(65) Prior Publication Data

US 2016/0321984 A1 Nov. 3, 2016

(30) Foreign Application Priority Data

Apr. 29, 2015 (KR) ..... 10-2015-0060928

(51) Int. Cl.
*G09G 5/39* (2006.01)
*G09G 3/20* (2006.01)
*G09G 3/36* (2006.01)

(52) U.S. Cl.
CPC ..... *G09G 3/2096* (2013.01); *G09G 3/3614* (2013.01); *G09G 3/3688* (2013.01); *G09G 2310/0254* (2013.01); *G09G 2310/08* (2013.01); *G09G 2330/028* (2013.01)

(58) Field of Classification Search
CPC ..... G09G 5/363; G09G 5/39; G09G 5/393; G06F 12/0292
USPC ..... 345/532
See application file for complete search history.

(56) References Cited

U.S. PATENT DOCUMENTS 8,723,899 B2 * 5/2014 Kim ..... G09G 3/3614 345/691
8,738,860 B1 * 5/2014 Griffin ..... G06F 12/0897 711/122
2008/0001890 A1 * 1/2008 Song ..... G09G 3/3614 345/96
2012/0086681 A1 * 4/2012 Kim ..... G09G 3/3648 345/204
2014/0204005 A1 * 7/2014 Wyatt ..... G09G 3/3611 345/87

* cited by examiner

*Primary Examiner* — Ke Xiao
*Assistant Examiner* — Gordon Liu
(74) *Attorney, Agent, or Firm* — Fenwick & West LLP

(57) ABSTRACT

A display device including plural timing controllers is provided. The display device includes a display panel, first and second data drive circuits, first and second timing controllers. The display panel includes pixels and data lines. The first data drive circuit supplies data voltages to a part of the data lines. The second data drive circuit supplies data voltages to the other of the data lines. The first and second timing controllers controls the display panel according to a first inversion scheme when images displayed by first and second image data do not include predetermined problem patterns, and controls the display panel according to an inversion scheme other than the first inversion scheme when the images displayed by the first and second image data include at least one of the predetermined problem patterns.

27 Claims, 7 Drawing Sheets

FIG. 9A

SP

| | | | | | | | | | | | | | | | |
|---|---|---|---|---|---|---|---|---|---|---|---|---|---|---|---|
| + | − | + | − | + | − | + | − | + | − | + | − | + | − | + | − |
| + | − | + | − | + | − | + | − | + | − | + | − | + | − | + | − |
| − | + | − | + | − | + | − | + | − | + | − | + | − | + | − | + |
| − | + | − | + | − | + | − | + | − | + | − | + | − | + | − | + |
| + | − | + | − | + | − | + | − | + | − | + | − | + | − | + | − |
| + | − | + | − | + | − | + | − | + | − | + | − | + | − | + | − |
| − | + | − | + | − | + | − | + | − | + | − | + | − | + | − | + |
| − | + | − | + | − | + | − | + | − | + | − | + | − | + | − | + |

Y
X

FIG. 9B

SP

| | | | | | | | | | | | | | | | |
|---|---|---|---|---|---|---|---|---|---|---|---|---|---|---|---|
| + | + | − | − | + | + | − | − | + | + | − | − | + | + | − | − |
| + | + | − | − | + | + | − | − | + | + | − | − | + | + | − | − |
| − | − | + | + | − | − | + | + | − | − | + | + | − | − | + | + |
| − | − | + | + | − | − | + | + | − | − | + | + | − | − | + | + |
| + | + | − | − | + | + | − | − | + | + | − | − | + | + | − | − |
| + | + | − | − | + | + | − | − | + | + | − | − | + | + | − | − |
| − | − | + | + | − | − | + | + | − | − | + | + | − | − | + | + |
| − | − | + | + | − | − | + | + | − | − | + | + | − | − | + | + |

Y
X

DISPLAY DEVICE

CROSS REFERENCE TO RELATED APPLICATION

This application claims priority under 35 U.S.C. § 119(a) to Republic of Korea Patent Application No. 10-2015-0060928 filed on Apr. 29, 2015, which is incorporated by reference herein in its entirety.

BACKGROUND

Technical Field

Embodiments of the present invention relate to a display device including plural timing controllers.

Related Art

With advancement of information society, requirements for display devices displaying an image have increased more and more in various forms. Recently, various display devices such as a liquid crystal display (LCD), a plasma display panel (PDP), and an organic light emitting diode (OLED) have been used.

A display device includes a display panel, a gate drive circuit, a data drive circuit, and a timing controller. The display panel includes data lines, gate lines, and pixels that are formed at intersections of the data lines and the gate lines and that are supplied with data voltages of the data lines when the gate lines are supplied with gate signals. The pixels emit light with predetermined brightness depending on the data voltages. The gate drive circuit supplied the gate signals to the gate lines. The data drive circuit includes source drive integrated circuits (hereinafter, referred to as "IC") that supplies the data voltages to the data lines. The timing controller controls operation timings of the gate drive circuit and the data drive circuit.

In recent years, high-resolution display devices such as ultra-high definition (UHD) (3840×2160) display devices have come to the market. With an increase in requirement of consumers for high-resolution display devices, display devices with a 5K3K (5120×2880) resolution have been developed. Since the horizontal resolution of a display device with a 5K3K resolution is higher than the horizontal resolution of the UHD display device, the number of source drive ICs of the display device with a 5K3K resolution is larger than that of the UHD display device. Accordingly, it is necessary to develop a new timing controller for application to the display device with a 5K3K resolution. However, the development of a new timing controller causes a problem with large costs and time. Therefore, recently, operation timings of the gate drive circuit and the data drive circuit are controlled using plural timing controllers.

On the other hand, when an image with a specific problem pattern is displayed on a display panel, the image quality may degrade. In order to solve this problem, when digital video data including an image with a specific problem pattern is detected, the degradation in image quality is improved by changing a scheme of inversion is performed. However, when plural timing controllers are used, the timing controllers individually recognize the image with a specific problem pattern and individually change their scheme of performing the inversion. Accordingly, a difference in image quality due to the different scheme of inversion may occur between an image in an area of the display panel which is controlled by a first timing controller and an image in an area of the display panel which is controlled by a second timing controller. That is, the quality of an image displayed on the display device may degrade.

SUMMARY

A display device according to an embodiment of the present invention includes a display panel, a gate drive circuit, a first data drive circuit, a second data drive circuit, a first timing controller, and a second timing controller. The display panel includes gate lines, data lines, and pixels disposed at intersections of the gate lines and the data lines. The gate drive circuit supplies gate signals to the gate lines. The first data drive circuit includes source drive ICs of a first group that supply data voltages to a part of the data lines. The second data drive circuit includes source drive ICs of a second group that supply data voltages to the other of the data lines. The first timing controller supplies first image data and a first polarity control signal to the first data drive circuit. The second timing controller supplies second image data and a second polarity control signal to the second data drive circuit. The first and second timing controllers control the display panel according to a first inversion scheme when images displayed by the first and second image data do not include predetermined problem patterns, and control the display panel according to an inversion scheme other than the first inversion scheme when the images displayed by the first and second image data include at least one of the predetermined problem patterns.

Embodiments relate to a display device comprising a display panel, a first timing controller, and a second timing controller. The display panel includes data lines and pixels connected to the data lines. The first timing controller receives first image data and control timing of operations associated with first data voltages corresponding to the first image data to be sent over a first subset of the data lines to a first subset of the pixels. The second timing controller receives second image data and control timing of operations associated with second data voltages corresponding to the second image data to be sent over a second subset of the data lines to a second subset of the pixels. The second timing controller determines an inversion scheme to be applied to the first and second subsets of data lines based on a problem pattern detected in the first image data or the second image data.

In one embodiment, the second timing controller generates an inversion control signal indicating the problem pattern detected in the first image data or the second image data; and sends the inversion control signal to the first timing controller.

In one embodiment, the display device further includes a first data drive circuit between the first set of data lines and the first timing controller, and a second data drive circuit between the second set of data lines and the second timing controller. The first data drive circuit provides the first data voltages to the first subset of the data lines by applying the determined inversion scheme to the first image data. The second data drive circuit provides the second data voltages to the second subset of the data lines by applying the determined inversion scheme to the second image data.

Embodiments also relate to a method of controlling a display device. A problem pattern in first image data is detected responsive to receiving the first image data by a first timing controller. The problem pattern is detected in second image data responsive to receiving the second image data by a second timing controller. An inversion scheme corresponding to the detected problem pattern in the first image data or in the second image data is determined responsive to detecting the problem pattern in the first image data or the second image data. The inversion scheme to data voltages corresponding to the first image data and the second image data are determined. The data voltages applied with the inversion scheme over data lines are sent to pixels.

Embodiments also relate to a timing controller for a display panel including a plurality of problem pattern determining circuits, a pattern signal computation circuit and an inversion control signal output. Each of the plurality of second pattern determining circuits detects one of a plurality of predetermined problem patterns in a first part of an image data. The pattern signal computation circuit is coupled to the problem pattern determining circuits and another timing controller for controlling timing associated with a second part of the image data. The pattern signal computation circuit determines an inversion scheme to be applied to the image data based on first problem pattern signals from the plurality of problem pattern determining circuits and second problem patterns from the other timing controller. The first problem pattern signals indicate whether the first part of the image data includes the one of the plurality of predetermined problem patterns. The second problem pattern signals indicate whether the second part of the image data includes the one of the plurality of predetermined problem patterns. The inversion control signal output circuit sends an inversion control signal to the other timing controller to apply the determined inversion scheme to the second part of the image data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings:

FIGS. 9A to 9C are diagrams illustrating vertical two-dot inversion scheme, square 2×2 inversion scheme, and column inversion scheme.

DESCRIPTION OF EMBODIMENTS

Figure 1:
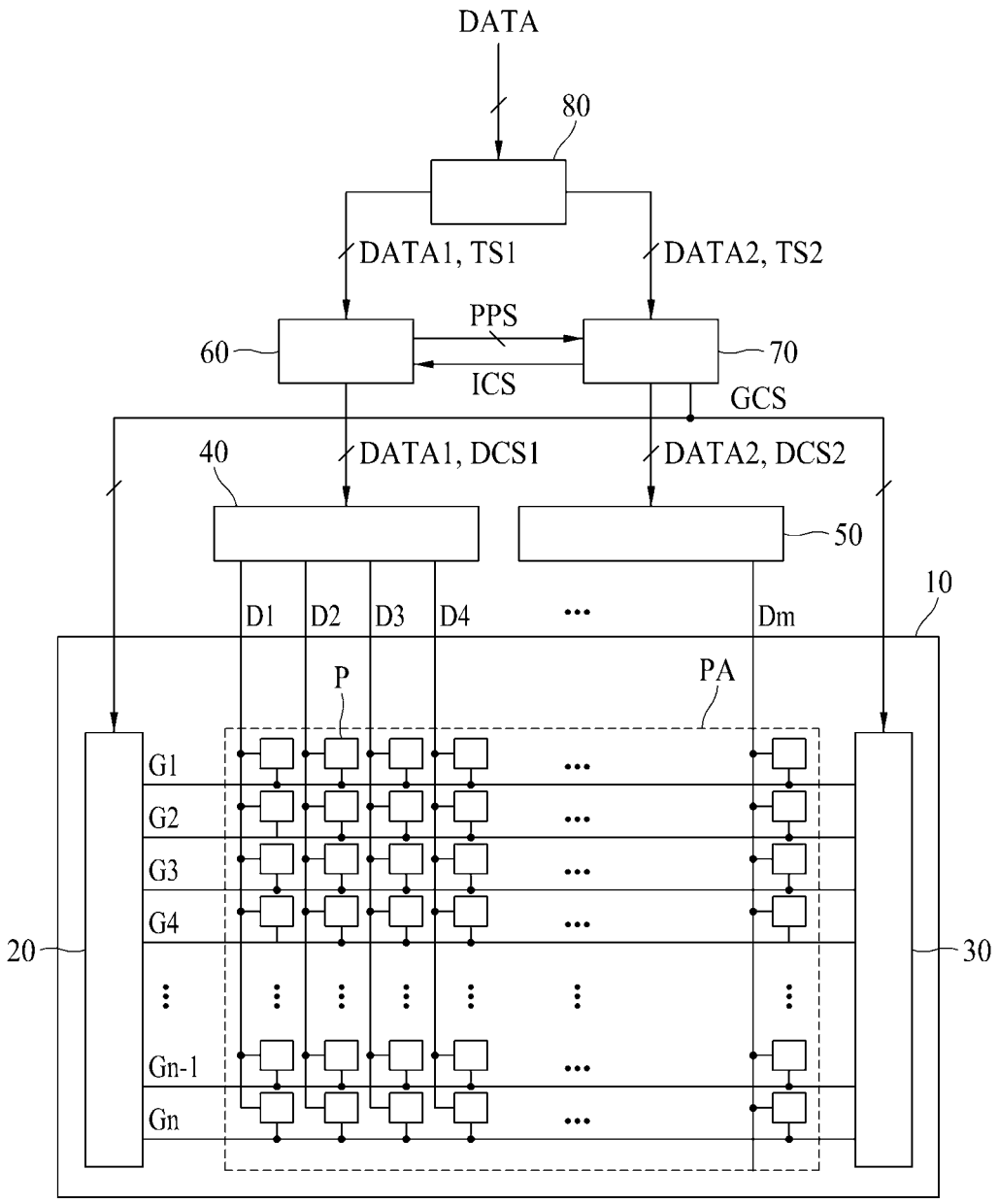
FIG. 1 is a diagram illustrating an example of a display device according to an embodiment of the present invention.

Reference will now be made in detail to the exemplary embodiments of the present invention, examples of which are illustrated in the accompanying drawings. Wherever possible, the same reference numbers will be used throughout the drawings to refer to the same or like parts.

Advantages and features of the invention and methods for achieving the advantages or features will be apparent from embodiments described below in detail with reference to the accompanying drawings. However, the invention is not limited to the embodiments but can be modified in various forms. The embodiments are provided merely for completing the disclosure of the invention and are provided for completely informing those skilled in the art of the scope of the invention. The scope of the invention is defined by only the appended claims.

Shapes, sizes, ratios, angles, number of pieces, and the like illustrated in the drawings, which are provided for the purpose of explaining the embodiments of the invention, are exemplary and thus the invention is not limited to the illustrated details. In the following description, like elements are referenced by like reference numerals. When it is determined that detailed description of the known techniques relevant to the invention makes the gist of the invention obscure, the detailed description thereof will not be made.

When "include," "have", "be constituted", and the like are mentioned in the specification, another element may be added unless "only" is used. A singular expression of an element includes two or more elements unless differently mentioned.

In construing elements, an error range is included even when explicit description is not made.

For example, when positional relationships between two parts are described using 'on-', 'over-', 'under-', 'next-', and the like, one or more other parts may be disposed between the two parts unless 'just' or 'direct' is used.

For example, when temporal relationships are described using "after", "subsequent to", "next", "before", and the like, such expression may include temporal discontinuity unless "immediately" or "directly" is used.

Terms "first", "second", and the like can be used to describe various elements, but the elements should not be limited to the terms. The terms are used only to distinguish an element from another. Therefore, a first element may be a second element within the technical spirit of the invention.

An "X-axis direction", a "Y-axis direction", and a "Z-axis direction" should not be analyzed as a geometrical relationship in which the directions are perpendicular to each other, and can mean wider directivity within a range in which the configurations of the present invention can be functionally used.

The term, "at least one", should be understood to include all combinations available from one or more relevant items. For example, "at least one of a first item, a second item, and a third item" means to include all combinations available from two or more of the first item, the second item, and the third item as well as each of the first item, the second item, and the third item.

Features of the embodiments of the invention can be coupled or combined partially or on the whole and can be technically interlinked and driven in various forms. The embodiments may be put into practice independently or in combination.

Hereinafter, the embodiments of the invention will be described in detail with reference to the accompanying drawings.

Figure 2:
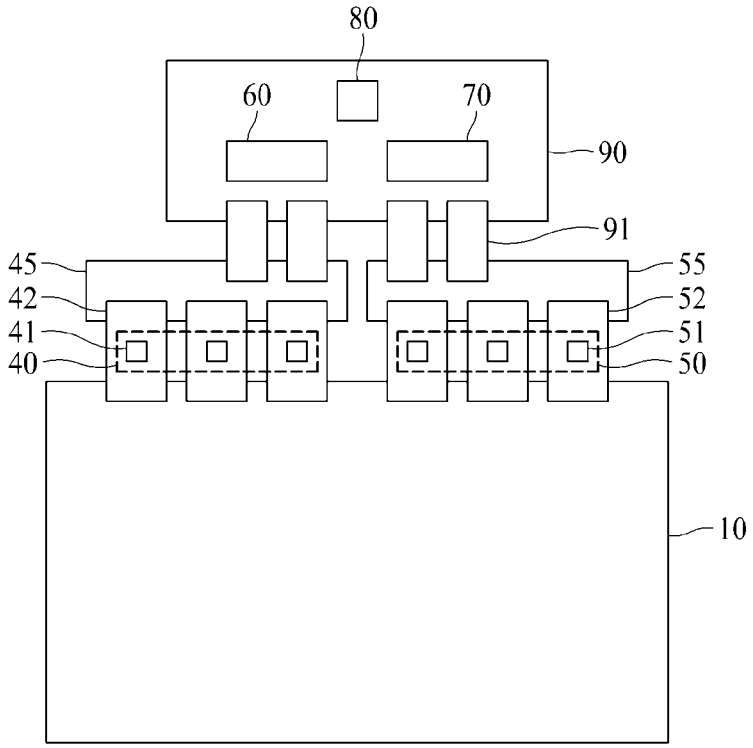
FIG. 2 is a diagram illustrating a lower substrate, source drive ICs, source flexible films, a source circuit board, a control circuit board, and first and second timing controllers of the display device according to the embodiment of the present invention.

FIG. 1 is a diagram illustrating an example of a display device according to an embodiment of the present invention. FIG. 2 is a diagram illustrating a lower substrate, source drive ICs, source flexible films, a source circuit board, a control circuit board, and first and second timing controllers of the display device according to the embodiment of the present invention.

A display device according to the embodiment of the present invention may include any display device that supplies data voltages to pixels by line sequence scanning of sequentially supplying gate signals to gate lines G1 to Gn. For example, the display device according to the embodiment of the present invention can be embodied as one of a liquid crystal display device, an organic light-emitting display device, a field emission display device, and an electrophoresis display device.

Referring to FIGS. 1 and 2, the display device according of the embodiment of the present invention includes a display panel 10, first and second gate drive circuits 20 and 30, first and second data drive circuits 40 and 50, and first and second timing controllers 60 and 70.

The display panel 10 includes an upper substrate and a lower substrate. A pixel array PA including data lines D1 to Dm (where m is a positive integer equal to or greater than 2), gate lines G1 to Gn (where n is a positive integer equal to or greater than 2), and pixels P is formed on the lower substrate. Each pixel P can be connected to one of the data lines D1 to Dm and one of the gate lines G1 to Gn. Accordingly, each pixel P is supplied with a data voltage of the corresponding data line when a gate signal is supplied to the corresponding gate line, and emits light with predetermined brightness depending on the supplied data voltage.

Figure 3:
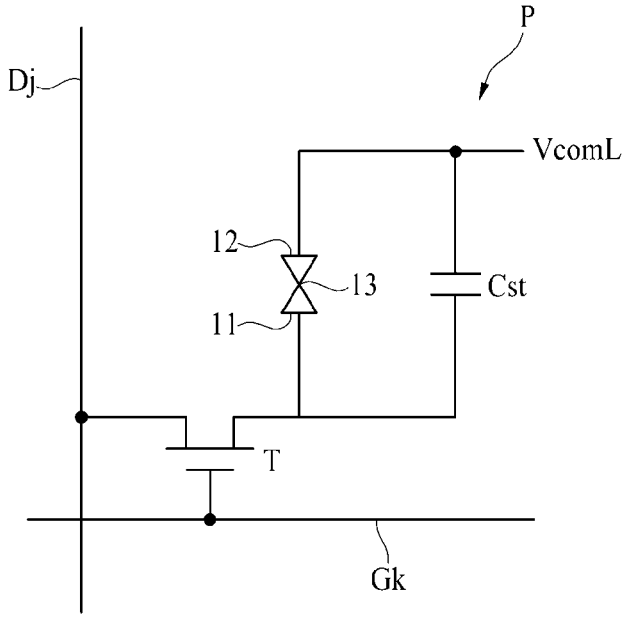
FIG. 3 is a circuit diagram illustrating a pixel in FIG. 1.

When the display device is embodied as a liquid crystal display device, each pixel P may include a transistor T, a pixel electrode 11, and a storage capacitor Cst as illustrated in FIG. 3. The transistor T supplies a data voltage of the j-th data line Dj (where j is a positive integer satisfying $1 \leq k \leq m$) to the pixel electrode 11 in response to a gate signal of the k-th gate line Gk (where k is a positive integer satisfying $1 \leq k \leq n$). Accordingly, each pixel P drives the liquid crystal of a liquid crystal layer 13 to adjust transmission of light incident from a backlight unit by an electric field generated due to a potential difference between the data voltage supplied to the pixel electrode 11 and a common voltage supplied to a common electrode 12. The common electrode 12 is supplied with the common voltage from a common voltage line VcomL, and the backlight unit is disposed below the display panel 10 and irradiates the display panel 10 with uniform light. The storage capacitor Cst is disposed between the pixel electrode 11 and the common electrode 12 and keeps the voltage difference between the pixel electrode 11 and the common electrode 12 constant.

The first gate drive circuit 20 is connected to the gate lines G1 to Gn. The first gate drive circuit 20 is supplied with a first gate control signal GCS1 from the first timing controller 60, generates gate signals in response to the first gate control signal GCS1, and supplies the gate signals to the gate lines G1 to Gn.

The second gate drive circuit 30 is connected to the gate lines G1 to Gn. The second gate drive circuit 30 is supplied with a second gate control signal GCS2 from the second timing controller 70, generates gate signals in response to the second gate control signal GCS2, and supplies the gate signals to the gate lines G1 to Gn.

The first and second gate drive circuits 20 and 30 may be disposed in a non-display area around a display area PA of the display panel 10 in a gate-in-panel (GIP) scheme as illustrated in FIG. 1. In this case, the first gate drive circuit 20 may be disposed on the left side of the display area PA and the second gate drive circuit 30 may be disposed on the right side of the display area PA. Each of the first and second gate drive circuits 20 and 30 may include plural gate drive integrated circuits (hereinafter, referred to as "ICs") and the gate drive ICs may be mounted on gate flexible films. Each gate flexible film may be a tape carrier package or a chip-on-film. The gate flexible films may be attached to the non-display area of the display panel 10 in a tape automated bonding (TAB) scheme using an anisotropic conductive film, and thus the gate drive ICs can be connected to the gate lines G1 to Gn.

The first data drive circuit 40 includes source drive ICs 41 of a first group as illustrated in FIG. 2. Each of the source drive ICs 41 of the first group is supplied with first image data DATA1 and a first data control signal DCS1 from the first timing controller 60 and converts the first image data DATA1 into analog data voltages in response to the first data control signal DCS1. The source drive ICs 41 of the first group supply the data voltages to a part of the data lines D1 to Dm.

The first data control signal DCS1 may include a first source start signal, a first source sampling clock, a first source output enable signal, and a first polarity control signal. The first source start signal is a signal for controlling a data sampling start point of the first data drive circuit 40. The first source sampling clock is a clock signal for controlling a sampling operation of the first data drive circuit 40 based on a rising or falling edge. The polarity control signal is a signal for inverting the polarity of the data voltages output from the first data drive circuit 40 with an L horizontal period cycle (where L is a positive integer). Since the source drive ICs 41 and 51 control the polarity of the data voltages based on the polarity control signal, the inversion scheme of the display panel 10 is determined by the polarity control signal. For example, the source drive ICs 41 and 51 output the data voltages to the data lines D1 to Dm in positive or negative polarity based on the polarity control signal. The first source output enable signal is a signal for controlling outputting of the data voltage from the first data drive circuit 40.

The second data drive circuit 50 includes source drive ICs 51 of a second group as illustrated in FIG. 2. Each of the source drive ICs 51 of the second group is supplied with second image data DATA2 and a second data control signal DCS2 from the second timing controller 70 and converts the second image data DATA2 into analog data voltages in response to the second data control signal DCS2. The source drive ICs 51 of the second group supply the data voltages to the other of the data lines D1 to Dm, for example, the other data lines.

The second data control signal DCS2 may include a second source start signal, a second source sampling clock, a second source output enable signal, and a second polarity control signal. The second source start signal is a signal for controlling a data sampling start point of the second data drive circuit 50. The second source sampling clock is a clock signal for controlling a sampling operation of the second data drive circuit 50 based on a rising or falling edge. The polarity control signal is a signal for inverting the polarity of the data voltages output from the second data drive circuit 50 with an L horizontal period cycle. Since the source drive ICs 41 and 51 control the polarity of the data voltages based on the polarity control signal, the inversion scheme of the display panel 10 is determined by the polarity control signal. For example, the source drive ICs 41 and 51 output the data voltages to the data lines D1 to Dm in positive or negative polarity based on the polarity control signal. The second source output enable signal is a signal for controlling outputting of the data voltage from the second data drive circuit 50.

The source drive ICs 41 and 51 are individually manufactured as drive chips. The source drive ICs 41 of the first data drive circuit 40 may be mounted on first source flexible films 42. The source drive ICs 51 of the second data drive circuit 50 may be mounted on second source flexible films 52. The first and second source flexible films 42 and 52 are individually embodied by a tape carrier package or a chip-on-film and may be curved or bent. The first and second source flexible films 42 and 52 may be attached to the non-display area of the display panel 10 by TAB (Taped Automated Bonding) using an anisotropic conductive film; and thus, the source drive ICs 41 and 51 may be connected to the data lines D1 to Dm.

The first source flexible films 42 can be attached to a first source printed circuit board 45, and the second source flexible films 52 can be attached to a second source printed circuit board 55. The first and second source printed circuit boards 45 and 55 may be flexible printed circuit boards which can be curved or bent.

The first timing controller 60 is supplied with first image data DATA1 and first timing signals TS1 from a scaler 80. The first timing signals TS1 may include a first vertical sync signal, a first horizontal sync signal, a first data enable signal, and a first dot clock.

Figure 4:
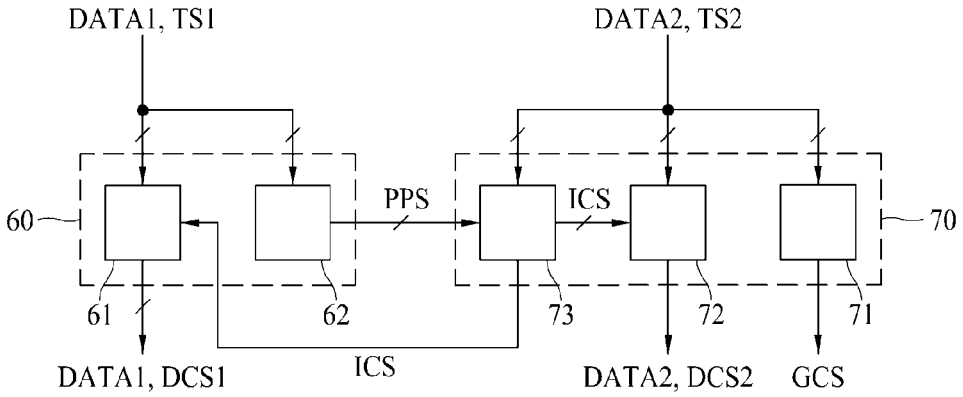
FIG. 4 is a block diagram specifically illustrating the first and second timing controllers illustrated in FIG. 1.

The first timing controller 60 includes a first data control signal generating unit 61 and a first problem pattern determining unit 62 as illustrated in FIG. 4.

The first data control signal generating unit 61 generates a first data control signal DCS1 for controlling an operation timing of the first data drive circuit 40 based on the first timing signals TS1 and outputs the generated first data control signal to the first data drive circuit 40.

The first problem pattern determining unit 62 determines whether an image displayed by the first image data DATA1 includes predetermined problem patterns. When the image displayed by the first image data DATA1 does not include the predetermined problem patterns, the first problem pattern determining unit 62 outputs first problem pattern signals PPS with a first logic level voltage to the second timing controller 70. When the image displayed by the first image data DATA1 includes one of the predetermined problem patterns, the first problem pattern determining unit 62 outputs a first problem pattern signal corresponding to the one problem pattern with a second logic level to the second timing controller 70 and outputs the other first problem pattern signal(s) with a first logic level voltage to the second timing controller 70. Alternatively, when the image displayed by the first image data DATA1 includes two or more of the predetermined problem patterns, the first problem pattern determining unit 62 outputs the first problem pattern signals corresponding to the two or more problem patterns with the second logic level voltage to the second timing controller 70 and outputs the other first problem pattern signal(s) with the first logic level voltage to the second timing controller 70. Details of the output of the problem pattern signals PPS of the first problem pattern determining unit 62 will be described later with reference to FIG. 5.

The first problem pattern determining unit 62 may be mounted on a control printed circuit board 90. The control printed circuit board 90 and the first source printed circuit board 45 can be connected by a flexible circuit board 91 such as a flexible flat cable (FFC) or a flexible printed circuit (FPC).

The second timing controller 70 is supplied with second image data DATA2 and second timing signals TSs from the scaler 80. The second timing signals TS2 may include a second vertical sync signal, a second horizontal sync signal, a second data enable signal, and a second dot clock. The first and second vertical sync signals are signals for defining one frame period, the first and second horizontal sync signals are signals for defining one horizontal period, the first and second data enable signals are signals for indicating effective data output, and the first and second dot clocks are clock signals having a predetermined cycle.

The second timing controller 70 includes a gate control signal generating unit 71, a second data control signal generating unit 72, and a second problem pattern determining unit 73 as illustrated in FIG. 4.

The gate control signal generating unit 71 generates gate control signals GCS for controlling the operation timings of the gate drive circuits 20 and 30 and outputs the gate control signals to the gate drive circuits 20 and 30. The gate control signal GCS may include a gate start signal (GSP), a gate shift clock (GSC), and a gate output enable signal (GOE). The gate start signal is a signal for controlling the output timing of a first gate pulse in one frame period. The gate shift clock is a clock signal for shifting the gate start signal. The gate output enable signal is a signal for controlling an output width of each gate signal. In FIG. 4, the second timing controller 70 includes the gate control signal generating unit 71, but the present invention is not limited to this configuration. That is, the gate control signal generating unit 71 may be included in any one of the first and second timing controllers 60 and 70 or may be included in both the first and second timing controllers 60 and 70.

The second data control signal generating unit 72 generates a second data control signal DCS2 for controlling the operation timing of the second data drive circuit 50 based on the second timing signals TS2 and outputs the second data control signal to the second data drive circuit 50.

When the first problem pattern signals PPS with the first logic level voltage is input and the image displayed by the second image data DATA2 does not include predetermined problem patterns, the second timing controller 70 outputs an inversion control signal ICS of a first value to the first data control signal generating unit 61 of the first timing controller 60. When the first problem pattern signals with the second logic level voltage is input and the image displayed by the second image data DATA2 includes at least one of the predetermined problem patterns, the second timing controller 70 outputs an inversion control signal ICS of a second value to the first data control signal generating unit 61 of the first timing controller 60. Details of the output of the inversion control signal ICS from the second timing controller 70 will be described later with reference to FIG. 5.

The second timing controller 70 may be mounted on the control printed circuit board 90 as illustrated in FIG. 2. The control printed circuit board 90 and the second source printed circuit board 55 can be connected by a flexible circuit board 91 such as an FFC or an FPC.

The scaler 80 is supplied with image data DATA from an external host system (not illustrated). The scaler 80 generates first image data DATA1 and second image data DATA2 based on resolution information of the display panel 10. The scaler 80 supplies the first image data DATA1 to the first timing controller 60 and supplies the second image data DATA2 to the second timing controller 70. The scaler 80 can be mounted on the control printed circuit board 90 as illustrated in FIG. 2. Alternatively, the scaler 80 may be mounted on an external host system (not illustrated).

As described above, in the embodiment of the present invention, the operations of the first and second gate drive circuits 20 and 30 and the first and second data drive circuits 40 and 50 are controlled using multiple timing controllers 60 and 70. As a result, in the embodiment of the present invention, since multiple timing controllers can be applied to a display device with a resolution higher than the resolution which can be controlled by a single timing controller, it is possible to decrease time and costs for development of a new timing controller.

In the embodiment of the present invention, when the images displayed by the first and second image data DATA1 and DATA2 do not include predetermined problem patterns, the display panel 10 is controlled using the first inversion scheme through the first and second timing controllers 60 and 70. When the images displayed by the first and second image data DATA1 and DATA2 include at least one of the predetermined problem patterns, the display panel 10 is controlled according to an inversion scheme other than the first inversion scheme. That is, in the embodiment of the present invention, by setting the inversion schemes which are controlled by the plural timing controllers to the same, it is possible to prevent a difference in image quality in the areas of the display panel controlled by different timing controllers. This will be described in detail with reference to FIG. 5.

On the other hand, the first and second timing controllers 60 and 70 according to the embodiment of the present invention can change power modes of the source drive ICs 41 and 51 as well as the inversion schemes depending on whether the images displayed by the first and second image data DATA1 and DATA2 include the predetermined problem patterns. For example, the first and second timing controllers 60 and 70 according to the embodiment of the present invention can control to reduce the current consumption of the source drive ICs 41 and 51 when the images displayed by the first and second image data DATA1 and DATA2 include at least one of the predetermined problem patterns.

In the embodiment of the present invention, the second timing controller 70 is used as a master timing controller and the first timing controller 60 is used as a slave timing controller, but the present invention is not limited to this configuration.

In the embodiment of the present invention, the display device includes two timing controllers 60 and 70, but the present invention is not limited to this configuration. That is, the display device may include three or more timing controllers.

Figure 5:
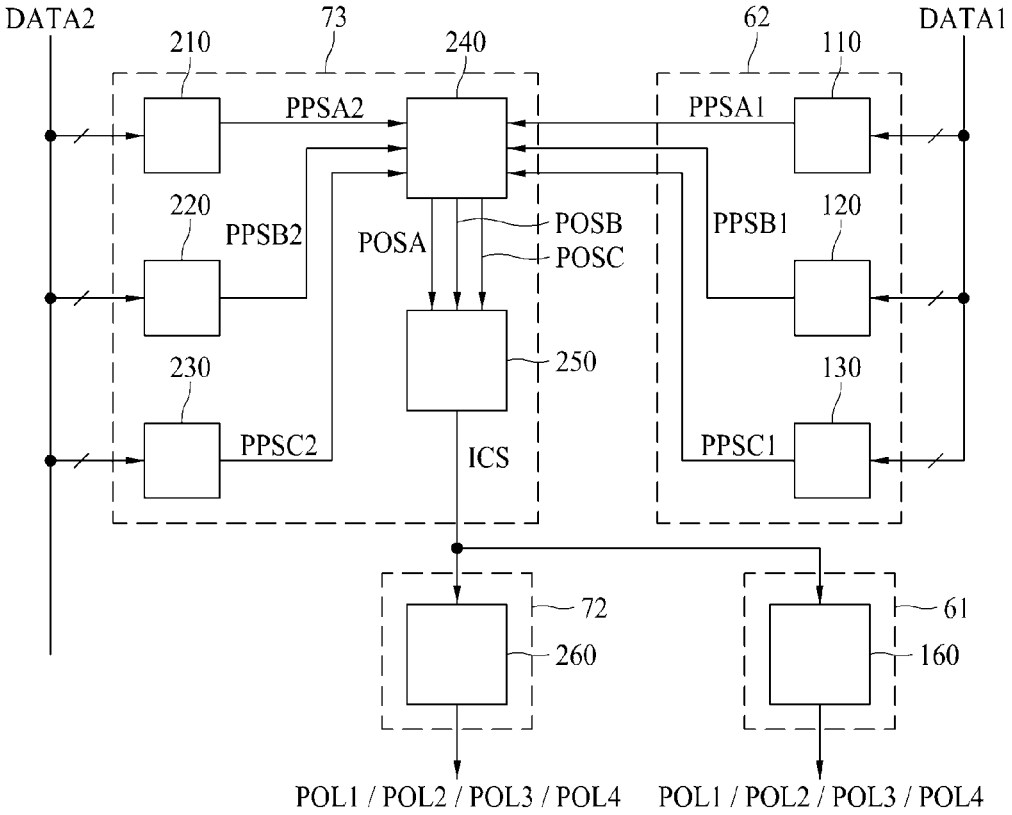
FIG. 5 is a block diagram specifically illustrating first and second problem pattern determining units and first and second polarity control signal output units in FIG. 4.

FIG. 5 is a block diagram specifically illustrating the first and second problem pattern determining units and the first and second polarity control signal output units illustrated in FIG. 4.

The first problem pattern determining unit 62 may include multiple first problem pattern determining units as illustrated in FIG. 5. For example, the first problem pattern determining unit 62 may include a first A problem pattern determining unit 110, a first B problem pattern determining unit 120, and a first C problem pattern determining unit 130 as illustrated in FIG. 5.

Figure 6A:
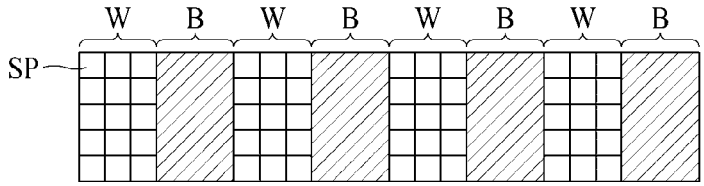
FIGS. 6A to 6C are diagrams illustrating examples of an A problem pattern, a B problem pattern, and a C problem pattern.

The first A problem pattern determining unit 110 determines whether the image displayed by the first image data DATA1 includes an A problem pattern. The A problem pattern may be a shutdown pattern in which white W and black B are arranged in the horizontal direction for each pixel as illustrated in FIG. 6A. In FIG. 6A, one pixel includes three sub pixels SP. When the image displayed by the first image data DATA1 does not include the A problem pattern, the first A problem pattern determining unit 110 outputs a first A problem pattern signal PPSA1 with a first logic level voltage to the second problem pattern determining unit 73 of the second timing controller 70. When the image displayed by the first image data DATA1 includes the A problem pattern, the first A problem pattern determining unit 110 outputs the first A problem pattern signal PPSA1 with a second logic level voltage to the second problem pattern determining unit 73 of the second timing controller 70.

Figure 6B:
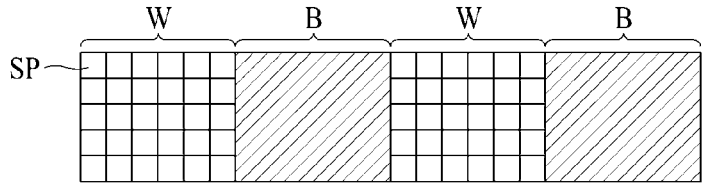

The first B problem pattern determining unit 120 determines whether the image displayed by the first image data DATA1 includes a B problem pattern. The B problem pattern may be a smear pattern in which white W and black B are arranged in the horizontal direction for every two pixels as illustrated in FIG. 6B. In FIG. 6B, one pixel includes three sub pixels SP. When the image displayed by the first image data DATA1 does not include the B problem pattern, the first B problem pattern determining unit 120 outputs a first B problem pattern signal PPSB1 with a first logic level voltage to the second problem pattern determining unit 73 of the second timing controller 70. When the image displayed by the first image data DATA1 includes the B problem pattern, the first B problem pattern determining unit 120 outputs the first B problem pattern signal PPSB1 with a second logic level voltage to the second problem pattern determining unit 73 of the second timing controller 70.

Figure 6C:
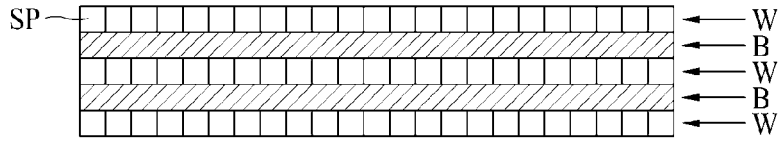

The first C problem pattern determining unit 130 determines whether the image displayed by the first image data DATA1 includes a C problem pattern. The C problem pattern may be a pattern in which white W and black B are arranged for each horizontal line as illustrated in FIG. 6C. When the image displayed by the first image data DATA1 does not include the C problem pattern, the first C problem pattern determining unit 130 outputs a first C problem pattern signal PPSC1 with a first logic level voltage to the second problem pattern determining unit 73 of the second timing controller 70. When the image displayed by the first image data DATA1 includes the C problem pattern, the first C problem pattern determining unit 130 outputs the first C problem pattern signal PPSC1 with a second logic level voltage to the second problem pattern determining unit 73 of the second timing controller 70.

The second problem pattern determining unit 73 may include multiple second problem pattern determining units 210, 220, and 230, a pattern signal computing unit 240, and an inversion control signal output unit 250 as illustrated in FIG. 5. For example, the plural second problem pattern determining units 210, 220, and 230 may include a second A problem pattern determining unit 210, a second B problem pattern determining unit 220, and a second C problem pattern determining unit 230 as illustrated in FIG. 5.

The second A problem pattern determining unit 210 determines whether the image displayed by the second image data DATA2 includes an A problem pattern. The A problem pattern may be a shutdown pattern in which white W and black B are arranged like a mosaic as illustrated in FIG. 6A. When the image displayed by the second image data DATA2 does not include the A problem pattern, the second A problem pattern determining unit 110 outputs a second A problem pattern signal PPSA2 with a first logic level voltage to the pattern signal computing unit 240. When the image displayed by the second image data DATA2 includes the A problem pattern, the second A problem pattern determining unit 110 outputs the second A problem pattern signal PPSA2 with a second logic level voltage to the pattern signal computing unit 240.

The second B problem pattern determining unit 220 determines whether the image displayed by the second image data DATA2 includes a B problem pattern. The B problem pattern may be a smear pattern which causes a smear defect as illustrated in FIG. 6B. The smear pattern may be an image pattern in which white is arranged in a black background as illustrated in FIG. 6B. When the image displayed by the second image data DATA2 does not include the B problem pattern, the second B problem pattern determining unit 220 outputs a second B problem pattern signal PPSB2 with a first logic level voltage to the pattern signal computing unit 240. When the image displayed by the second image data DATA2 includes the B problem pattern, the second B problem pattern determining unit 220 outputs the second B problem pattern signal PPSB2 with a second logic level voltage to the pattern signal computing unit 240.

The second C problem pattern determining unit 230 determines whether the image displayed by the second image data DATA2 includes a C problem pattern. The C problem pattern may be a pattern in which white W and black B are arranged for each horizontal line as illustrated in FIG. 6C. When the image displayed by the second image data DATA2 does not include the C problem pattern, the second C problem pattern determining unit 230 outputs a second C problem pattern signal PPSC2 with a first logic level voltage to the pattern signal computing unit 240. When the image displayed by the pattern signal computing unit 240 image data DATA2 includes the C problem pattern, the pattern signal computing unit 240 C problem pattern determining unit 230 outputs the pattern signal computing unit 240 C problem pattern signal PPSC2 with a second logic level voltage to the pattern signal computing unit 240.

The pattern signal computing unit 240 is supplied with the first A problem pattern signal PPSA1 from the first A problem pattern determining unit 110, the first B problem pattern signal PPSB1 from the first B problem pattern determining unit 120, and the first C problem pattern signal PPSC1 from the first C problem pattern determining unit 130. The pattern signal computing unit 240 is supplied with the second A problem pattern signal PPSA2 from the second A problem pattern determining unit 210, the second B problem pattern signal PPSB2 from the second B problem pattern determining unit 220, and the second C problem pattern signal PPSC2 from the second C problem pattern determining unit 230.

Figure 7:
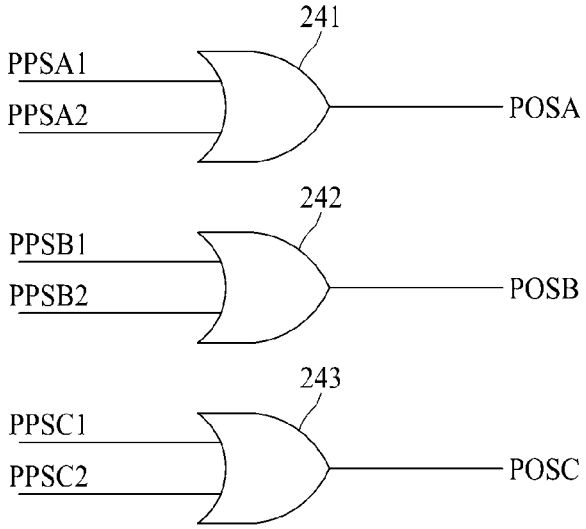
FIG. 7 is a circuit diagram specifically illustrating a pattern signal computing unit in FIG. 4.

The pattern signal computing unit 240 includes a first logical sum gate 241 that computes a logical sum of the A problem pattern signals as illustrated in FIG. 7. The pattern signal computing unit 240 computes a logical sum of the first A problem pattern signal PPSA1 and the second A problem pattern signal PPSA2 using the first logical sum gate 241 and outputs the computed A pattern computation signal POSA to the inversion control signal output unit 250. For example, it is assumed that the first logic level voltage indicates "0" and the second logic level voltage indicates "1." In this case, when both the first A problem pattern signal PPSA1 and the second A problem pattern signal PPSA2 have the first logic level voltage, the pattern signal computing unit 240 outputs the A pattern computation signal POSA with the first logic level voltage to the inversion control signal output unit 250. When one of the first A problem pattern signal PPSA1 and the second A problem pattern signal PPSA2 has the second logic level voltage, the pattern signal computing unit 240 outputs the A pattern computation signal POSA with the second logic level voltage to the inversion control signal output unit 250.

The pattern signal computing unit 240 includes a second logical sum gate 242 that computes a logical sum of the B problem pattern signals as illustrated in FIG. 7. The pattern signal computing unit 240 computes a logical sum of the first B problem pattern signal PPSB1 and the second B problem pattern signal PPSB2 using the second logical sum gate 242 and outputs the computed B pattern computation signal POSB to the inversion control signal output unit 250. For example, it is assumed that the first logic level voltage indicates "0" and the second logic level voltage indicates "1." In this case, when both the first B problem pattern signal PPSB1 and the second B problem pattern signal PPSB2 have the first logic level voltage, the pattern signal computing unit 240 outputs the B pattern computation signal POSB with the first logic level voltage to the inversion control signal output unit 250. When one of the first B problem pattern signal PPSB1 and the second B problem pattern signal PPSB2 has the second logic level voltage, the pattern signal computing unit 240 outputs the B pattern computation signal POSB with the second logic level voltage to the inversion control signal output unit 250.

The pattern signal computing unit 240 includes a third logical sum gate 243 that computes a logical sum of the C problem pattern signals as illustrated in FIG. 7. The pattern signal computing unit 240 computes a logical sum of the first C problem pattern signal PPSC1 and the second C problem pattern signal PPSC2 using the third logical sum gate 243 and outputs the computed C pattern computation signal POSC to the inversion control signal output unit 250. For example, it is assumed that the first logic level voltage indicates "0" and the second logic level voltage indicates "1." In this case, when both the first C problem pattern signal PPSC1 and the second C problem pattern signal PPSC2 have the first logic level voltage, the pattern signal computing unit 240 outputs the C pattern computation signal POSC with the first logic level voltage to the inversion control signal output unit 250. When one of the first C problem pattern signal PPSC1 and the second C problem pattern signal PPSC2 has the second logic level voltage, the pattern signal computing unit 240 outputs the C pattern computation signal POSB with the second logic level voltage to the inversion control signal output unit 250.

As described above, the pattern signal computing unit 240 computes a logical sum of the first problem pattern signals PPSA1, PPSB1, and PPSC1 input from the first problem pattern determining unit 62 and the second problem pattern signals PPSA2, PPSB2, and PPSC2 input from the second problem pattern determining unit 73, and outputs the pattern computation signals POSA, POSB, and POSC corresponding to the computation result of the logical sum. That is, in the embodiment of the present invention, it is not determined whether each of the image displayed by the first image data DATA1 and the image displayed by the second image data DATA2 includes the problem patterns, but it is determined whether any one of the image displayed by the first image data DATA1 and the image displayed by the second image data DATA2 includes the problem patterns. Accordingly, according to the embodiment of the present invention, it is possible to prevent multiple timing controllers from determining whether an image includes problem patterns differently.

The inversion control signal output unit 250 is supplied with the A pattern computation signal POSA, the B pattern computation signal POSB, and the C pattern computation signal POSC. In step S101 in FIG. 8, the inversion control signal output unit 250 determines whether all of the A pattern computation signal POSA, the B pattern computation signal POSB, and the C pattern computation signal POSC are input with the first logic level voltage. When the A pattern computation signal POSA with the first logic level voltage, the B pattern computation signal POSB with the first logic level voltage, and the C pattern computation signal POSC with the first logic level voltage are input, the inversion control signal output unit 250 outputs an inversion control signal ICS of a first value (steps S101 and S102).

Figure 8:
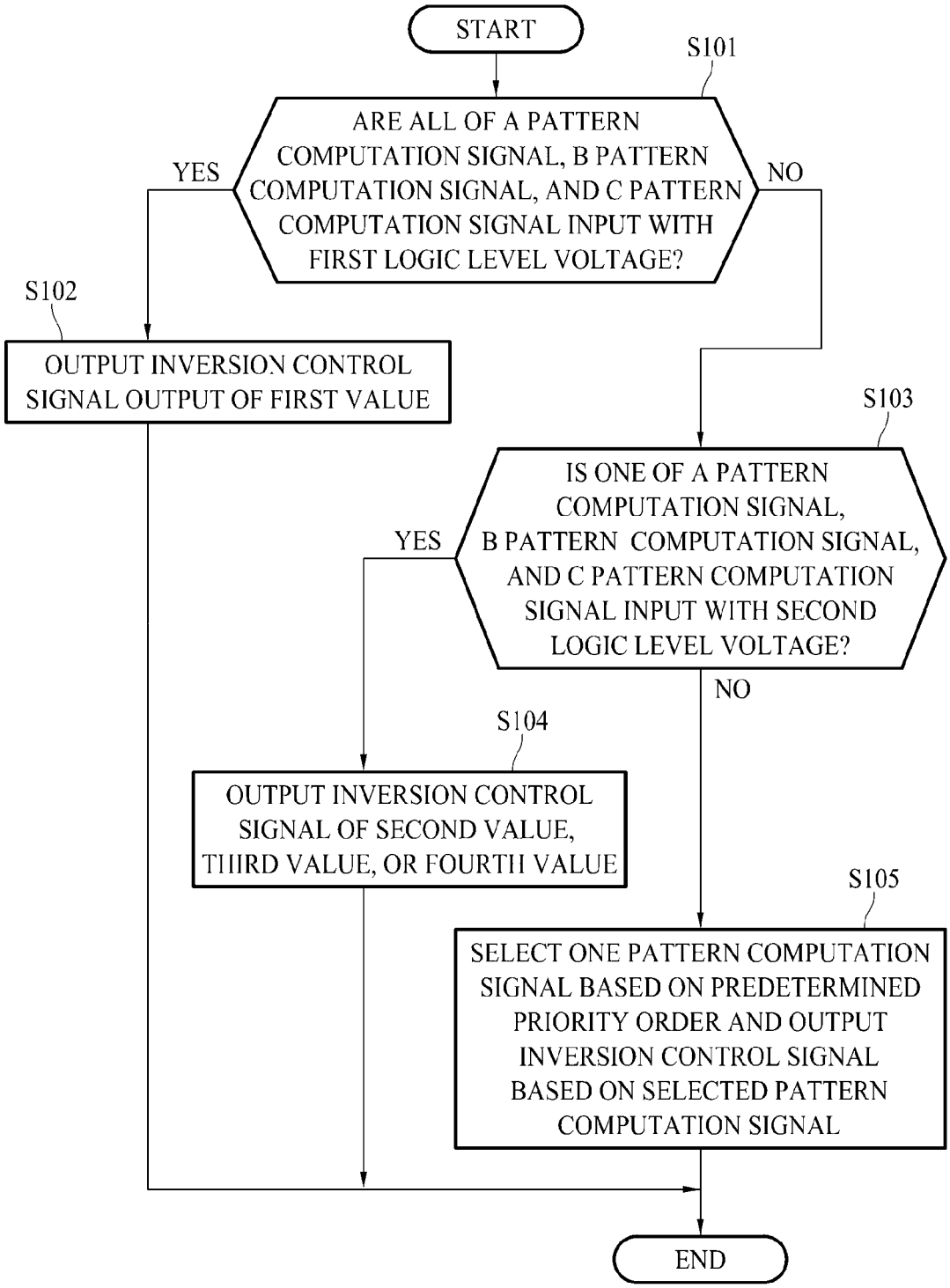
FIG. 8 is a flowchart specifically illustrating an inversion control signal output method of an inversion control signal output unit in FIG. 4.

In step S103 in FIG. 8, the inversion control signal output unit 250 determines whether any one of the A pattern computation signal POSA, the B pattern computation signal POSB, and the C pattern computation signal POSC is input with the second logic level voltage. For example, when only the A pattern computation signal POSA is input with the second logic level voltage, the inversion control signal output unit 250 outputs the inversion control signal ICS of a second value. When only the B pattern computation signal POSB is input with the second logic level voltage, the inversion control signal output unit 250 outputs the inversion control signal ICS of a third value. When only the C pattern computation signal POSC is input with the second logic level voltage, the inversion control signal output unit 250 outputs the inversion control signal ICS of a fourth value (steps S103 and S104).

In step S105 in FIG. 8, the inversion control signal output unit 250 outputs the inversion control signal ICs when two or more of the A pattern computation signal POSA, the B pattern computation signal POSB, and the C pattern computation signal POSC are input with the second logic level voltage. Specifically, when two or more signals of the A pattern computation signal POSA, the B pattern computation signal POSB, and the C pattern computation signal POSC are input with the second logic level voltage, the inversion control signal output unit 250 selects one pattern computation signal in a predetermined priority order and outputs the inversion control signal ICS based on the selected pattern computation signal. For example, it is assumed that the priority of the A pattern is the highest and the priority of the B pattern is the second highest. In this case, when the A pattern computation signal POSA is input with the second logic level voltage, the inversion control signal output unit 250 selects the A pattern computation signal POSA regardless of the other pattern computation signals based on the priority order and outputs the inversion control signal ICS of the second value. When the A pattern computation signal POSA is input with the first logic level voltage and the B pattern computation signal POSB is input with the second logical level voltage, the inversion control signal output unit 250 selects the B pattern computation signal POSB regardless of the C pattern computation signal POSC based on the priority order and outputs the inversion control signal ICS of the second value (step S105).

The inversion control signal output unit 250 outputs the inversion control signal ICS to the first and second polarity control signal output units 160 and 260. Each of the first and second polarity control signal output units 160 and 260 is supplied with the inversion control signal ICS from the inversion control signal output unit 250. The first and second polarity control signal output units 160 and 260 differently output the polarity control signal depending on the inversion control signal ICS.

When the inversion control signal ICS of the first value is received, each of the first and second polarity control signal output units 160 and 260 outputs a first polarity control signal POL1 to drive the display panel according to a first inversion scheme. In this case, the source drive ICs 41 and 51 illustrated in FIG. 1 outputs data voltages to the data lines D1 to Dm in a positive or negative polarity depending on the first polarity control signal POL1 so as to drive the display panel according to the first inversion scheme.

When the images displayed by the first and second image data DATA1 and DATA2 do not include the A problem pattern, the B problem pattern, and the C problem pattern, the inversion control signal ICS of the first value is input to the first and second polarity control signal output units 160 and 260. For example, the first inversion scheme may be a horizontal one dot inversion and vertical two dot inversion scheme as illustrated in FIG. 9A. The horizontal one-dot inversion scheme is a scheme in which the polarity of the data voltage supplied is inverted for each pixel in the horizontal direction (x-axis direction) as illustrated in FIG. 9A. The vertical two-dot inversion scheme is a scheme in which the polarity of the data voltages supplied is inverted for every two pixels in the vertical direction (y-axis direction) as illustrated in FIG. 9A. The horizontal direction (x-axis direction) is a direction parallel to the gate lines and the vertical direction (y-axis direction) is a direction parallel to the data lines.

When the inversion control signal ICS of the second value is received, each of the first and second polarity control signal output units 160 and 260 outputs a second polarity control signal POL2 to drive the display panel according to a second inversion scheme. In this case, the source drive ICs 41 and 51 illustrated in FIG. 1 outputs data voltages to the data lines D1 to Dm in a positive or negative polarity depending on the second polarity control signal POL2 so as to drive the display panel according to the second inversion scheme.

When the images displayed by the first and second image data DATA1 and DATA2 include the A problem pattern or the A problem pattern is selected based on the priority order, the inversion control signal ICS of the second value is input to the first and second polarity control signal output units 160 and 260. For example, the second inversion scheme may be a square 2×2 inversion scheme as illustrated in FIG. 9B. The square 2×2 inversion scheme is a scheme in which the polarity of the data voltage supplied is inverted for every four pixels including two pixels in the horizontal direction (x-axis direction) and two pixels in the vertical direction (y-axis direction) as illustrated in FIG. 9B. The horizontal direction (x-axis direction) is a direction parallel to the gate lines and the vertical direction (y-axis direction) is a direction parallel to the data lines.

When the inversion control signal ICS of the third value is input, each of the first and second polarity control signal output units 160 and 260 outputs a third polarity control signal POL3 to drive the display panel according to a third inversion scheme. In this case, the source drive ICs 41 and 51 illustrated in FIG. 1 outputs data voltages to the data lines D1 to Dm in a positive or negative polarity depending on the third polarity control signal POL3 so as to drive the display panel according to the third inversion scheme.

When the images displayed by the first and second image data DATA1 and DATA2 include the B problem pattern or the B problem pattern is selected based on the priority order, the inversion control signal ICS of the third value is input to the first and second polarity control signal output units 160 and 260. For example, the third inversion scheme may be a square 2×2 inversion scheme as illustrated in FIG. 9B.

When the inversion control signal ICS of the fourth value is input, each of the first and second polarity control signal output units 160 and 260 outputs a fourth polarity control signal POL4 to drive the display panel according to a fourth inversion scheme. In this case, the source drive ICs 41 and 51 illustrated in FIG. 1 outputs data voltages to the data lines D1 to Dm in a positive or negative polarity depending on the fourth polarity control signal POL4 so as to drive the display panel according to the fourth inversion scheme.

Figure 9C:
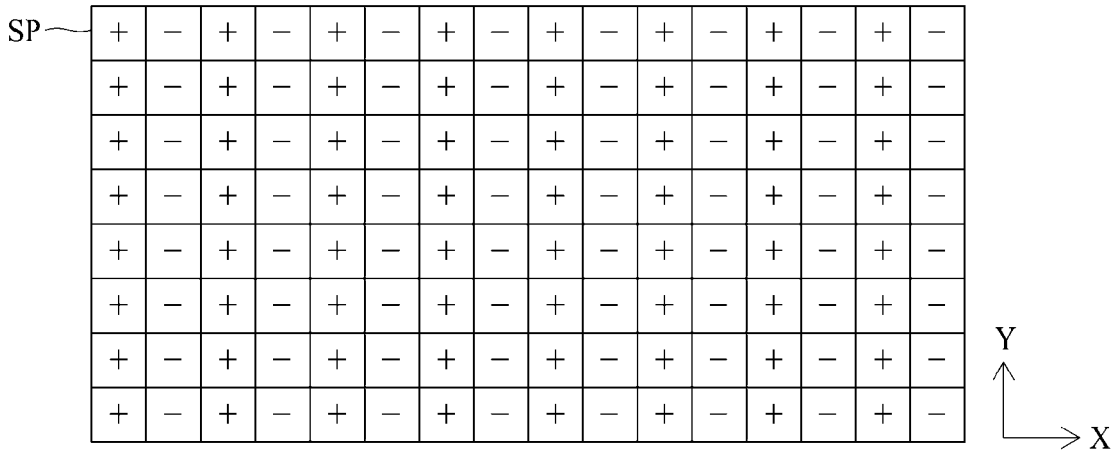

When the images displayed by the first and second image data DATA1 and DATA2 include the C problem pattern or the C problem pattern is selected based on the priority order, the inversion control signal ICS of the fourth value is input to the first and second polarity control signal output units 160 and 260. For example, the fourth inversion scheme may be a column inversion scheme as illustrated in FIG. 9C. The column inversion scheme is a scheme in which the polarity of the data voltages supplied is inverted for every pixel in the vertical direction (y-axis direction) as illustrated in FIG. 9C.

The first polarity control signal output unit 310 may be included in the first data control signal generating unit 62. The second polarity control signal output unit 410 may be included in the second data control signal generating unit 73.

As described above, in the embodiment of the present invention, the operations of the first and second gate drive circuits and the first and second data drive circuits are controlled using plural timing controllers. As a result, in the embodiment of the present invention, since plural timing controllers can be applied to a display device having a resolution higher than the resolution which can be controlled by a single timing controller, it is possible to decrease time and cost for development of a new timing controller.

In the embodiment of the present invention, the first and second timing controllers 60 and 70 are used to control the display panel 10 according to the first inversion scheme when the images displayed by the first and second image data DATA1 and DATA2 do not include the predetermined problem patterns, and to control the display panel 10 according to an inversion scheme other than the first inversion scheme when the images displayed by the first and second image data DATA1 and DATA2 include at least one of the predetermined problem patterns. That is, according to the embodiment of the present invention, by setting the inversion schemes which are controlled by plural timing controllers to the same, it is possible to prevent a difference in image quality from occurring between the areas of the display panel which are controlled by the plural timing controllers.

From the above-mentioned details, those skilled in the art will be able to understand that the present invention can be changed and modified in various forms without departing from the technical spirit of the present invention. Therefore, the technical scope of the present invention is not limited to the above-described details but will be defined by the appended claims.

What is claimed is:

1. A display device comprising:

a display panel including data lines and pixels;

a first data drive circuit including source drive integrated circuits (ICs) of a first group and configured to supply data voltages to a first subset of the data lines;

a second data drive circuit including source drive ICs of a second group and configured to supply data voltages to a second subset of the data lines;

a first timing controller configured to supply first image data to the first data drive circuit; and a second timing controller configured to supply second image data to the second data drive circuit, wherein the first and second timing controllers control the display panel according to a first inversion scheme when images displayed by the first and second image data do not include predetermined problem patterns, and control the display panel in according to an inversion scheme other than the first inversion scheme when the images displayed by the first and second image data include at least one of the predetermined problem patterns, wherein the first timing controller outputs first problem pattern signals to the second timing controller based on whether the image displayed by the first image data includes the predetermined problem patterns, and wherein the second timing controller outputs an inversion control signal to the first timing controller based on the first problem pattern signals and predetermined problem patterns in the image detected by the second timing controller, the inversion control signal indicating the control of the display panel according to the first inversion scheme or the inversion scheme other than the first inversion scheme.

2. The display device according to claim 1, wherein the first problem pattern signals has a first logic level voltage the image does not include the predetermined problem patterns.

3. The display device according to claim 2, wherein the first timing controller outputs the first problem pattern signal corresponding to one problem pattern of the predetermined problem patterns to the second timing controller with a second logic level voltage and outputs the first problem pattern signals other than the first problem pattern signal corresponding to the one problem pattern to the second timing controller with the first logic level voltage, when the image displayed by the first image data includes the one problem pattern.

4. The display device according to claim 3, wherein the second timing controller outputs an inversion control signal of a first value to the first timing controller to control the display panel according to the first inversion scheme when the image displayed by the second image data does not include the predetermined problem patterns and is supplied with the first problem pattern signal with the first logic level voltage.

5. The display device according to claim 4, wherein the second timing controller outputs an inversion control signal of a second value to the first timing controller to control the display panel according to an inversion scheme other than the first inversion scheme when the image displayed by the second image data includes at least one of the predetermined problem patterns and is supplied with the first problem pattern signal with the first logic level voltage.

6. The display device according to claim 4, wherein the first and second timing controllers output a first polarity control signal to the source drive ICs when the second timing controller outputs the inversion control signal of the first value to the first timing controller, and the first and second timing controllers output a second polarity control signal to the source drive ICs when the second timing controller outputs the inversion control signal of the second value to the first timing controller.

7. The display device according to claim 6, wherein the display panel is controlled according to the first inversion scheme when the source drive ICs of the first and second groups output the data voltages to the data lines in positive or negative polarity in response to the first polarity control signal, and the display panel is controlled according to the second inversion scheme when the source drive ICs of the first and second groups output the data voltages to the data lines in positive or negative polarity in response to the second polarity control signal.

8. The display device according to claim 2, wherein the first timing controller outputs the first problem pattern signals corresponding to a plurality of problem patterns of the predetermined problem patterns to the second timing controller with a second logic level voltage and outputs the first problem pattern signals other than the first problem pattern signals corresponding to the plurality of problem patterns to the second timing controller with the first logic level voltage, when the image displayed by the first image data includes the plurality of problem patterns.

9. The display device according to claim 1, wherein the first timing controller includes:

a first A problem pattern determining unit that outputs a first A problem pattern signal with a first logic level voltage when the image displayed by the first image data does not include an A problem pattern and outputs the first A problem pattern signal with a second logic level voltage when the image displayed by the first image data includes the A problem pattern; and a first B problem pattern determining unit that outputs a first B problem pattern signal with a first logic level voltage when the image displayed by the first image data does not include a B problem pattern and outputs the first B problem pattern signal with a second logic level voltage when the image displayed by the first image data includes the B problem pattern.

10. The display device according to claim 9, wherein the second timing controller includes:

a second A problem pattern determining unit that outputs a second A problem pattern signal with a first logic level voltage when the image displayed by the second image data does not include the A problem pattern and outputs the second A problem pattern signal with a second logic level voltage when the image displayed by the second image data includes the A problem pattern;

a second B problem pattern determining unit that outputs a second B problem pattern signal with a first logic level voltage when the image displayed by the second image data does not include the B problem pattern and outputs the second B problem pattern signal with a second logic level voltage when the image displayed by the second image data includes the B problem pattern;

a pattern signal computing unit that computes a logical sum of the first A problem pattern signal and the second A problem pattern signal, outputs an A pattern computation signal, computes a logical sum of the first B problem pattern signal and the second B problem pattern signal, and outputs a B pattern computation signal; and an inversion control signal output unit that outputs the inversion signal in response to the A pattern computation signal and the B pattern computation signal.

11. The display device according to claim 10, wherein the inversion control signal output unit outputs the inversion control signal of a first value when the A pattern computation signal with the first logic level voltage and the B pattern computation signal with the first logic level voltage are input, outputs the inversion control signal of a second value when the A pattern computation signal with the first logic level voltage and the B pattern computation signal with the second logic level voltage are input, outputs the inversion control signal of a third value when the A pattern computation signal with the second logic level voltage and the B pattern computation signal with the first logic level voltage are input, and outputs the inversion control signal of a fourth value when the A pattern computation signal with the second logic level voltage and the B pattern computation signal with the second logic level voltage are input.

12. The display device according to claim 11, wherein the first timing controller further includes a first polarity control signal output unit that outputs first to third polarity control signals to the source drive ICs of the first group in response to the first to third inversion control signals.

13. The display device according to claim 12, wherein the second timing controller further includes a second polarity control signal output unit that outputs first to third polarity control signals to the source drive ICs of the second group in response to the first to third inversion control signals.

14. A display device comprising:

a display panel including data lines and pixels connected to the data lines;

a first timing controller configured to receive first image data and control timing of operations associated with first data voltages corresponding to the first image data to be sent over a first subset of the data lines to a first subset of the pixels; and a second timing controller configured to receive second image data and control timing of operations associated with second data voltages corresponding to the second image data to be sent over a second subset of the data lines to a second subset of the pixels, the second timing controller configured to determine an inversion scheme to be applied to the first and second subsets of data lines based on a problem pattern detected in the first image data or the second image data, wherein the first timing controller outputs first problem pattern signals to the second timing controller based on whether the image displayed by the first image data includes the predetermined problem patterns, wherein the second timing controller outputs an inversion control signal to the first timing controller based on the first problem pattern signals and predetermined problem patters in the second image data detected by the second timing controller, the inversion control signal indicating the control of the display panel according to the first inversion scheme or the inversion scheme other than the first inversion scheme.

15. The display device of claim 14, further comprising:

a first data drive circuit between the first set of data lines and the first timing controller, the first data drive circuit configured to provide the first data voltages to the first subset of the data lines by applying the determined inversion scheme to the first image data; and a second data drive circuit between the second set of data lines and the second timing controller, the second data drive circuit configured to provide the second data voltages to the second subset of the data lines by applying the determined inversion scheme to the second image data.

16. The display device of claim 14, wherein the first timing controller comprises a plurality of first problem pattern determining circuits, each of the plurality of first pattern determining circuits configured to:

detect one of a plurality of predetermined problem patterns in the first image data; and send a first problem pattern signal to the second timing controller, the problem pattern signal indicating whether the first image data includes the one of the plurality of predetermined problem patterns, wherein the second timing controller is further configured to determine the inversion scheme based on the first problem pattern signal.

17. The display device of claim 16, wherein the second timing controller comprises a plurality of second problem pattern determining circuits, each of the plurality of second pattern determining circuits configured to:

detect one of a plurality of predetermined problem patterns in the second image data; and generate a second problem pattern signal indicating whether the second image data includes the one of the plurality of predetermined problem patterns, wherein the second timing controller is further configured to determine the inversion scheme based on the second problem pattern signal.

18. The display device of claim 17, further comprising:

a pattern signal computing circuit configured to:

receive the first problem pattern signal from each of the first pattern determining circuits and the second problem pattern signal from each of the second pattern determining circuits, and perform logical summing operation on the first problem pattern signal and the second problem pattern signal for a same problem pattern to generate a pattern computation signal;

an inversion control signal output circuit coupled to the pattern signal computing circuit to receive pattern computation signals and generate an inversion control signal indicating the problem pattern detected in the first image data or the second image data, wherein the first and second timing controller are configured to apply the determined inversion scheme to generate the data voltages for the first and second subsets of the data lines.

19. The display device of claim 14, wherein the problem pattern is one of a shutdown pattern, a smear pattern or a pattern in which white and black are arranged in horizontal lines of the first image data or the second image data.

20. A method of controlling a display device, comprising:

detecting a problem pattern in first image data responsive to receiving the first image data by a first timing controller;

detecting the problem pattern in second image data responsive to receiving the second image data by a second timing controller;

sending first problem pattern signals from the first timing controller to the second timing controller indicating whether the first timing controller detected predetermined problem patterns in the first image data;

determining, by the second timing controller, an inversion scheme corresponding to the detected problem pattern in the first image data or in the second image data responsive to detecting the problem pattern in the first image data or the second image data;

sending an inversion control signal from the second timing controller to the first timing controller, the inversion control signal indicating the determined inversion scheme;

applying the inversion scheme to data voltages corresponding to the first image data and the second image data; and sending the data voltages applied with the inversion scheme over data lines to pixels.

21. The method of claim 20, further comprising:

generating, by the second timing controller, an inversion control signal indicating the problem pattern detected in the first image data or the second image data; and sending the inversion control signal to the first timing controller to cause the determined inversion scheme to be applied to the first image data.

22. The method of claim 20, further comprising:

providing the data voltages to the first subset of the data lines by applying the determined inversion scheme to the first image data; and providing the data voltages to the second subset of the data lines by applying the determined inversion scheme to the second image data.

23. The method of claim 20, further comprising:

detecting one of a plurality of predetermined problem patterns in the first image data at each of a plurality of first pattern determining circuits in the first timing controller; and sending a first problem pattern signal from each of the plurality of first pattern determining circuits to the second timing controller, the first problem pattern signal indicating whether the first image data includes the one of the plurality of predetermined problem patterns, the second timing controller determining the inversion scheme based on the first problem pattern signal.

24. The method of claim 23, further comprising:

detecting one of a plurality of predetermined problem patterns in the second image data at each of a plurality of second pattern determining circuits; and generate a second problem pattern signal indicating whether the second image data includes the one of the plurality of predetermined problem patterns, the second timing controller determining the inversion scheme based on the second problem pattern signal.

25. The method of claim 24, wherein determining the inversion scheme comprises:

receiving the first problem pattern signal from each of the first pattern determining circuits and the second problem pattern signal from each of the second pattern determining circuits by a pattern signal computing circuit in the second timing controller;

performing logical summing operation on each set of the first problem pattern signal and the second problem pattern signal for a same problem pattern to generate a pattern computation signal; and generating an inversion control signal indicating the problem pattern detected in the first image data or the second image data, wherein the first and second timing controllers are configured to apply the determined inversion scheme to generate the data voltages for the data lines.

26. The method of claim 20, wherein the problem pattern is one of a shutdown pattern, a smear pattern or a pattern in which white and black are arranged in horizontal lines of the first image data or the second image data.

27. A timing controller for a display panel, comprising:

a plurality of problem pattern determining circuits, each of the plurality of second pattern determining circuits configured to detect one of a plurality of predetermined problem patterns in a first part of an image data;

a pattern signal computation circuit coupled to the problem pattern determining circuits and another timing controller for controlling timing associated with a second part of the image data, the pattern signal computation circuit configured to determine an inversion scheme to be applied to the image data based on first problem pattern signals from the plurality of problem pattern determining circuits in the timing controller and second problem patterns from the other timing controller, wherein the first problem pattern signals indicate whether the first part of the image data includes the one of the plurality of predetermined problem patterns, wherein the second problem pattern signals indicate whether the second part of the image data includes the one of the plurality of predetermined problem patterns; and an inversion control signal output circuit configured to send an inversion control signal to the other timing controller to apply the determined inversion scheme to the second part of the image data.

* * * * *